United States Patent [19]

Andrews

[11] 4,282,827

[45] Aug. 11, 1981

[54] DEVELOPMENT SYSTEM

[75] Inventor: Ronald A. Andrews, Pittsford, N.Y.

[73] Assignee: Xerox Corporation, Stamford, Conn.

[21] Appl. No.: 74,692

[22] Filed: Sep. 12, 1979

[51] Int. Cl.[3] ..... G03G 15/09

[52] U.S. Cl. ..... 118/648; 118/647; 118/651; 118/658

[58] Field of Search ..... 427/657, 648, 651, 658, 427/647; 430/103; 355/3 DD

[56] References Cited

U.S. PATENT DOCUMENTS

| | | | |
|---|---|---|---|
| 3,176,652 | 4/1965 | Mott et al. | 118/658 |
| 3,608,522 | 9/1971 | Davidson | 118/658 |
| 3,932,034 | 1/1976 | Takahashi | 355/3 DD |
| 3,950,089 | 4/1976 | Fraser et al. | 355/3 DD |
| 4,086,873 | 5/1978 | Morita et al. | 118/658 |

FOREIGN PATENT DOCUMENTS 54-34244 3/1979 Japan .

*Primary Examiner*—Evan K. Lawrence

*Attorney, Agent, or Firm*—H. M. Brownrout; H. Fleischer

[57] ABSTRACT

An apparatus in which conductive developer material is transported into contact with a region of a surface having image areas recorded thereon. An electrical field is generated and the developer material develops the image areas. In one mode of operation, the electrical field is substantially perpendicular to the surface over one portion of the region and substantially non-perpendicular thereto over the remaining portion of the region. In another mode of operation, the electrical field is substantially perpendicular to the surface over the entire region.

5 Claims, 4 Drawing Figures

DEVELOPMENT SYSTEM

BACKGROUND OF THE INVENTION

This invention relates generally to an electrophotographic printing machine, and more particularly concerns an apparatus for developing electrostatic latent images recorded on a photoconductive member.

In general, an electrophotographic printing machine comprises a photoconductive member which is charged to a substantially uniform potential so as to sensitize the surface thereof. The charged portion of the photoconductive surface is exposed to a light image of an original document being reproduced. This records an electrostatic latent image corresponding to the informational areas contained within the original document, on the photoconductive member. The electrostatic latent image is developed by bringing a developer mix into contact therewith. This forms a powder image on the photoconductive member which is subsequently transferred to a copy sheet. Finally, the copy sheet is heated to permanently fix the powder image thereto in image configuration.

A suitable developer mix comprises toner particles adhering triboelectrically to carrier granules. This two component mixture is brought into contact with the photoconductive surface. The toner particles are attracted from the carrier granules to the latent image and, to some extent to the non-image or background areas. Those particles adhering to the latent image form a powder image on the photoconductive surface. Hereinbefore, it has been difficult to develop both the large solid regions of the latent image and the lines thereof without developing the background regions. Frequently, solid area development resulted in the background areas attracting the toner particles thereto. Ultimately, the toner particles, in this unwanted or background region, are transferred to the copy sheet resulting in a degradation in copy quality. Different techniques have been employed in attempting to improve solid area development without developing the unwanted background regions. For example, a development electrode or screening technique is frequently employed to improve solid area development while suppressing development of the background areas which have a lower potential than the solid areas. However, these systems are all rather complex and have suffered from poor development latitude resulting in low density images being formed on the copy sheets.

Various approaches have been devised to improve development. The following disclosures appear to be relevant:

U.S. Pat. No. 3,176,652; Patentee: Mott et al.; Issued: Apr. 6, 1965.

U.S. Pat. No. 3,608,522; Patentee: Davidson; Issued: Sept. 28, 1971.

U.S. Pat. No. 3,950,089; Patentee: Fraser et al.; Issued: Apr. 13, 1976.

U.S. Pat. No. 4,086,873; Patentee: Morita et al.; Issued: May 2, 1978.

Japanese Patent Application No. 52-100746; Application Date: Aug. 22, 1977.

Japanese Laid Open No. 54-34244; Laid Open Date: Mar. 13, 1979; Applicant: Minolta Camera Company, Ltd..

Co-pending U.S. Application Ser. No. 63,893; Applicant: Burnham et al.; Filed: Aug. 3, 1979.

The relevant portions of the foregoing disclosures may be briefly summarized as follows:

Mott et al. describes a developing apparatus comprising an elongated magnet disposed interiorly of a rotatably mounted cylindrical shield. The shield is non-magnetic and also may be electrically insulating.

Davidson describes a pair of magnetic rollers. Each magnetic roller comprises an outer cylinder of non-magnetic material with an elongated bar magnet being disposed interiorly of each cylinder.

Fraser et al. discloses a magnetic brush development system having a rotatably driven applicator roll. As shown in FIG. 3, the applicator roll includes a magnet disposed within a conductive sleeve coated or held in intimate contact with a sheet of highly resistive material.

In FIG. 3, Morita et al. shows a magnetic brush development system comprising an electrically conductive cylindrical member having a layer of highly electrically insulating material coated thereon. The resistivity of the insulating layer ranges from about $10^8$ to about $10^{15}$ ohms per centimeter.

The Japanese patent application discloses a development system including a magnetic roll disposed interiorly of a sleeve. The sleeve is made from a double layered structure with the outer layer being a non-magnetic conductive cylinder and the inner-layer being a non-magnetic insulating member.

The co-pending U.S. patent application describes a conductive magnetic brush roller and an insulating brush roller. The conductive magnetic brush roller includes a non-magnetic, conductive tubular member having an elongated magnet disposed interiorly thereof. The insulating magnetic brush roller includes an insulating, non-magnetic, tubular member having a magnet disposed interiorly thereof. The insulating tubular member is preferably made from a phenolic material.

SUMMARY OF THE INVENTION

In accordance with the present invention, there is provided an apparatus for developing image areas recorded in a surface with a conductive developer material. Means are provided for transporting the developer material into contact with a region of the surface having the image areas recorded thereon. Means generate an electrical field between the transporting means and the surface extending at least over the region of the surface having the developer material in contact therewith. In one mode of operation, the electrical field is substantially perpendicular to the surface over one portion of the region and substantially non-perpendicular to the surface over the other portion of the region. In another mode of operation, the electrical field is substantially perpendicular to the surface of the entire region.

BRIEF DESCRIPTION OF THE DRAWINGS

Other aspects of the present invention will become apparent as the following description proceeds and upon reference to the drawings, in which.

DETAILED DESCRIPTION

While the present invention will hereinafter be described in connection with various embodiments thereof, it will be understood that it is not intended to limit the invention to these embodiments. On the contrary, it is intended to cover all alternatives, modifications and equivalents as may be included within the spirit and scope of the invention as defined by the appended claims.

Figure 1:
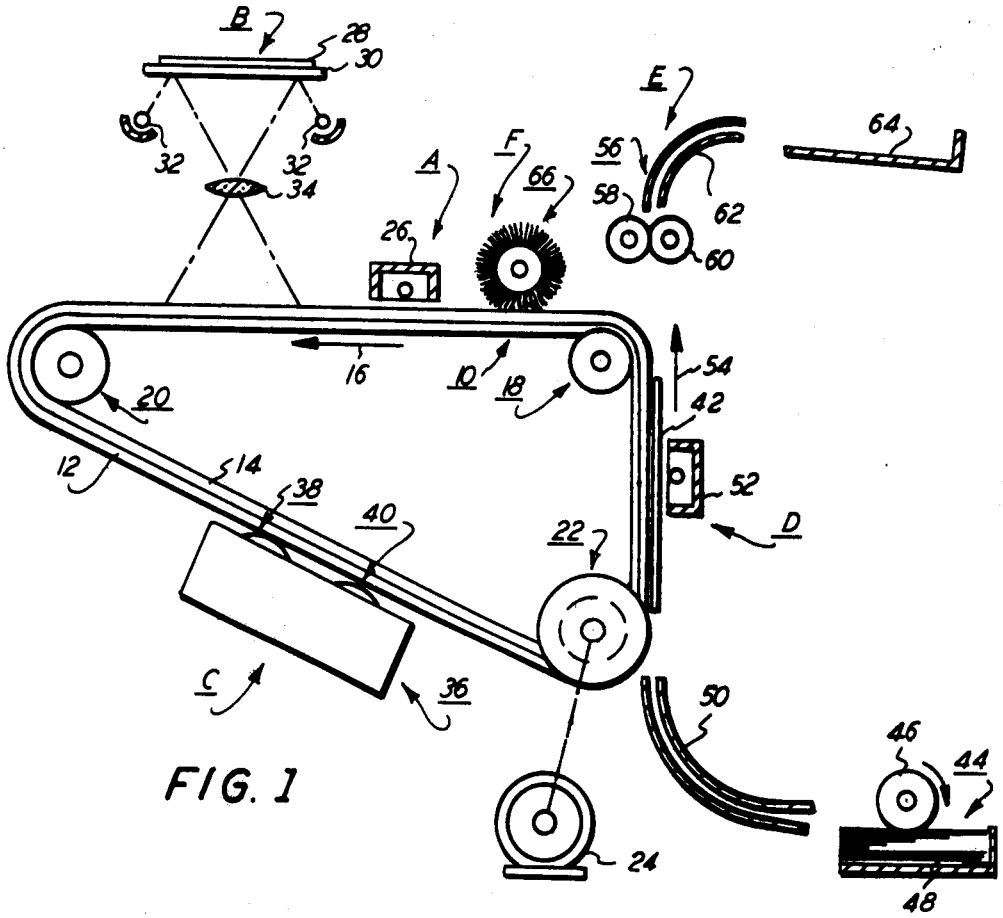
FIG. 1 is a schematic elevational view depicting an electrophotographic printing machine incorporating the features of the present invention therein.

For a general understanding of the features of the present invention, reference is had to the drawings. In the drawings, like reference numerals have been used throughout to designate identical elements. FIG. 1 schematically depicts the various components of an illustrative electrophotographic printing machine incorporating the various embodiments of the development apparatus of the present invention therein. It will become apparent from the following discussion that this development system is equally well suited for use in a wide variety of electrostatographic printing machines and is not necessarily limited in its application to the particular embodiments shown herein.

Inasmuch as the art electrophotographic printing is well known, the various processing stations employed in the FIG. 1 printing machine will be shown hereinafter schematically and their operation described briefly with reference thereto.

As shown in FIG. 1, the electrophotographic printing machine employs a belt 10 having a photoconductive surface 12 deposited on an electrically conductive substrate 14. Preferably, photoconductive surface 12 comprises a transport layer containing small molecules of m-TBD dispersed in a polycarbonate and a generation layer of trigonal selenium. Conductive substrate 14 is made preferably from aluminized Mylar which is electrically grounded. Other suitable photoconductive surfaces and conductive substrates may also be employed. Belt 10 moves in the direction of arrow 16 to advance successive portions of photoconductive surface 12 through the various processing stations disposed about the path of movement thereof. As shown, belt 10 is entrained about stripping roller 18, tension roller 20, and drive roller 22. Drive roller 22 is mounted rotatably and in engagement with belt 10. Motor 24 rotates roller 22 to advance belt 10 in the direction of arrow 16. Roller 22 is coupled to motor 24 by suitable means such as a drive belt. Drive roller 22 includes a pair of opposed spaced edge guides. The edge guides define a space therebetween which determines the desired path of movement for belt 10. Belt 10 is maintained in tension by a pair of springs (not shown) resiliently urging tension roller 22 against belt 10 with the desired spring force. Both stripping roller 18 and tension roller 20 are mounted rotatably. These rollers are idlers which rotate freely as belt 10 moves in the direction of arrow 16.

With continued reference to FIG. 1, initially a portion of belt 10 passes through charging station A. At charging station A, a corona generating device indicated generally by the reference numeral 26, charges photoconductive surface 12 of belt 10 to a relatively high, substantially uniform potential.

Next, the charged portion of photoconductive surface 12 is advanced through exposure station B. At exposure station B, an original document 28 is positioned face-down upon transparent platen 30. Lamps 32 flash light rays onto original document 28. The light rays reflected from original document 28 are transmitted through lens 34 forming a light image thereof. Lens 34 focuses the light image onto the charged portion of photoconductive surface 12 to selectively dissipate the charge thereon. This records image areas and non-image areas on photoconductive surface 12. The image areas or electrostatic latent image corresponds to the informational areas contained within the original document with the non-image areas being unwanted background regions.

Thereafter, belt 10 advances the electrostatic latent image recorded on photoconductive surface 12 to development station C. At development station C, a magnetic brush development system, indicated generally by the reference numeral 36, transports a conductive developer mixture of carrier granules and toner particles into contact with the photoconductive surface 12. One embodiment of magnetic brush development system 36 includes two magnetic brush rollers 38 and 40. These rollers each advance the developer mix into contact with photoconductive surface 12. Each developer roller forms a brush comprising carrier granules and toner particles. The toner particles are attracted from the carrier granules to the image areas forming a toner powder image on photoconductive surface 12 of belt 10. An alternate embodiment (FIG. 3) employs one magnetic brush roller. The detailed structure of each of these magnetic brush development systems will be described hereinafter with reference to FIGS. 2 through 5, inclusive.

After development, belt 10 advances the toner powder image to transfer station D. At transfer station D, a sheet of support material 42 is moved into contact with the toner powder image. The sheet of support material is advanced to transfer station D by a sheet feeding apparatus 44. Preferably, sheet feeding apparatus 44 includes a feed roll 46 contacting the uppermost sheet of stack 48. Feed roll 46 rotates so as to advance the uppermost sheet from stack 48 into chute 50. Chute 50 directs the advancing sheet of support material into contact with photoconductive surface 12 of belt 10 in a timed sequence so that the toner powder image developed thereon contacts the advancing sheet of support material at transfer station D.

Transfer station D includes a corona generating device 52 which sprays ions onto the backside of sheet 42. This attracts the toner powder image from photoconductive surface 12 to sheet 42. After transfer, the sheet continues to move in the direction of arrow 54 onto a conveyor (not shown) which advances the sheet to fusing station E.

Fusing station E includes a fuser assembly, indicated generally by the reference numeral 56, which permanently affixes the transferred toner powder image to sheet 42. Preferably, fuser assembly 56 includes a heated fuser roll 58 and a back-up roll 60. Sheet 42 passes between fuser roll 58 and back-up roll 60 with the toner powder image contacting fuser roll 58. In this manner, the toner powder image is permanently affixed to sheet 42. After fusing, chute 62 guides the advancing sheet 42 to catch tray 64 for subsequent removal from the printing machine by the operator.

Invariably, after the sheet of support material is separated from photoconductive surface 12 of belt 10, some residual particles remain adhering thereto. These residual particles are removed from photoconductive surface 12 at cleaning station F. Cleaning station F includes a pre-clean corona generating device (not shown) and a rotatably mounted fiberous brush 66 in contact with photoconductive surface 12. The pre-clean corona generator neutralizes the charge attracting the particles to the photoconductive surface. These particles are then cleaned from photoconductive surface 12 by the rotation of brush 66 in contact therewith. Subsequent to cleaning, a discharge lamp (not shown) floods photoconductive surface 12 with light to dissipate any residual charge remaining thereon prior to the charging thereof for the next successive imaging cycle.

It is believed that the foregoing description is sufficient for purposes of the present application to illustrate the general operation of an electrophotographic printing machine.

Figure 2:
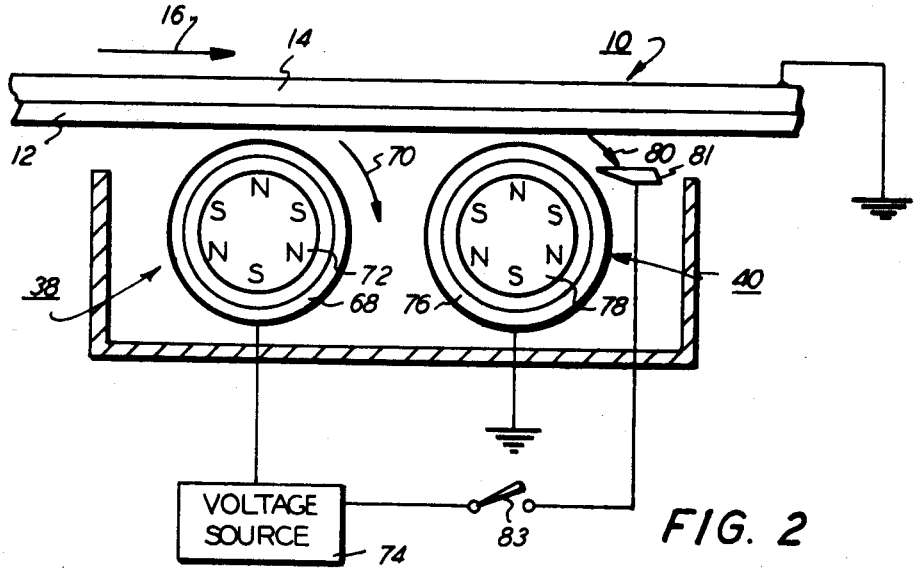
FIG. 2 is a schematic elevational view showing one embodiment of a development system used in the FIG. 1 printing machine.

Referring now to the specific subject matter of the present invention, FIG. 2 depicts one embodiment of development system 36 in greater detail. As depicted thereat, developer roller 38 includes a non-magnetic conductive tubular member 68 journaled for rotation. Preferably, tubular member 68 is made from aluminum having the exterior circumferential surface thereof roughened. Tubular member 68 rotates in the direction of arrow 70. An elongated magnetic rod 72 is positioned concentrically within tubular member 68 being spaced from the interior surface thereof. Magnetic rod 72 has a plurality of magnetic poles impressed thereon. By way of example, magnetic rod 72 is made preferably from barium ferrite. Tubular member 68 is electrically biased by voltage source 74. Voltage source 74 generates a potential having a suitable polarity and magnitude to electrically bias tubular member 68 to the desired level. Preferably, voltage source 74 electrically biases tubular member 68 to a level intermediate that of the background or non-image area voltage level and that of the image area voltage levels. Inasmuch as it is highly desirable to produce good solid area coverage, the voltage level is very close to that of the background areas. By way of example, voltage source 74 electrically biases tubular member 68 with a DC voltage ranging from about 25 volts to about 125 volts above the background potential.

In operation, the magnetic field generated by magnetic member 72 attracts the developer mixture to the exterior circumferential surface of tubular member 68. As tubular member 68 rotates in the direction of arrow 70, the developer composition is moved into contact with photoconductive surface 12. At this time, tubular member 68 is electrically biased by voltage source 74. Due to the nature of the conductive developer material, the electrical field being generated in the vicinity of tubular member 68 is substantially perpendicular to photoconductive surface 12. The image areas attract the toner particles from the carrier granules to form a powder image. However, inasmuch as the bias level is very close to that of the background level, frequently not only are the solid areas developed but the background areas as well may have toner particles and carrier granules deposited thereon. Obviously, it is desirable to remove these background particles while maintaining the solid areas of the image developed. In addition, it is also desirable to develop any low density lines or any portions of the solid areas that have not been developed by the first magnetic brush roller 38. The first magnetic brush roller 38 has difficulty in developing low density images or lines due to the inherent slow time response of the toner particles in a conductive developer material. This slow response time is a consequence of the perpendicular electrical field and the background potential driving the toner particles into the bed of developer material. The foregoing may be achieved by the second magnetic brush roller 40.

Developer roller 40 includes a resistive or electrically insulating, non-magnetic tubular member 76. This is distinctly different from tubular member 68 which is non-magnetic and conductive. Preferably, tubular member 76 is made from a phenolic resin having a resistivity range from about $10^5$ ohm-centimeters to about $10^8$ ohm-centimeters. Tubular member 76 is electrically grounded. An elongated magnetic rod 78 is positioned concentrically within tubular member 76 being spaced from the interior surface thereof. Magnetic rod 78 has a plurality of magnetic poles impressed thereon. By way of example, magnetic rod 78 is made from barium ferrite. Tubular member 76 rotates in the direction of arrow 80. In this way, as tubular member 76 rotates in the direction of arrow 80, a brush of developer mix is formed on the peripheral surface thereof. The brush of developer mix is transported into contact with photoconductive surface 12. Blade 81 has the leading edge thereof closely adjacent to tubular member 76 so as to meter the quantity of developer material being transported thereby. Preferably, blade 81 is made from an electrically conducting material such as stainless steel. When switch 83 is closed, voltage source 74 is connected to blade 81. In this manner, voltage source 74 electrically biases both blade 81 and tubular member 68. Preferably, blade 81 is electrically biased from a voltage level of about 50 volts to a voltage level of about 500 volts. Specific voltage levels selected depend upon the relative background and image area voltage levels. When switch 83 is opened, blade 81 remains unbiased. In one mode of operation, i.e. when switch 83 is closed, blade 81 is electrically biased and the resultant electrical field produced in the vicinity of tubular member 76 is substantially perpendicular to photoconductive surface 12. At this time, both the solid area region and lines within the image areas are further developed and the particles adhering to the background areas are removed therefrom. Alternatively, if switch 83 is opened, the electrical field in the vicinity of tubular member 76 is substantially non-perpendicular to photoconductive surface 12. Ideally, the electrical field would be parallel to photoconductive surface 12. However, in actuality the field is somewhat transverse thereto. In this latter mode of operation, the lines within the image areas are further developed and the particles adhering to the background areas are removed therefrom. It should be noted that the response time of the toner particles in the region of tubular member 76 is significantly faster when switch 83 is closed rather than opened and the electrical field is substantially perpendicular to photoconductive surface 12. It is clear that the development system depicted in FIG. 2 is capable of operating in two modes. In one mode of operation, the electrical field over a portion of the development zone is substantially perpendicular to the photoconductive surface with the electrical field over the remaining portion of the development zone being substantially non-perpendicular or transverse to the photoconductive surface. Alternatively, in another mode of operation, the electrical field is substantially perpendicular to the photoconductive surface over the entire development zone.

In the case of tubular member 68, the electrical field vector is substantially perpendicular to the photoconductive surface 12. When the electrical field vector is in the foregoing orientation, the conductivity of the development material appears to be maximized. Solid areas of the electrostatic latent image are optimumly developed when the electrical field vector is in this latter orientation. Hence, tubular member 68 develops the solid areas within the image areas recorded on photoconductive surface 12. Contrariwise, in one mode of operation, the electrical field vector in the vicinity of tubular member 76 is non-perpendicular to photoconductive surface 12. When the electrical field vector is in the foregoing orientation, the developer composition appears to have significantly lower conductivity. However, this may be due to the faster toner response time. Under these latter circumstances, low density or fine lines within the image areas are optimumly developed. In addition, residual particles adhering to the non-image or background areas are attracted back to tubular member 76. Hence, developer roller 40 acts both to develop the lines within the image area and to scavenge or clean up the background areas. In this manner, the image areas recorded on photoconductive surface 12 are optimumly developed with toner particles. Alternatively, when switch 83 is closed and blade 81 is coupled to voltage source 74, the electrical field vector in the vicinity of tubular member 76 is substantially perpendicular to photoconductive surface 12. Hence, not only does magnetic brush roller 38 develop the solid areas of the image areas, but developer roller 40 also develops both the solid and line areas in this latter mode of operation. In addition, the response time is significantly faster. Furthermore, magnetic brush roller 40 continues to act as a scavenging roller to remove any particles adhering to the background or non-image areas.

Developer compositions that are particularly useful are those that comprise magnetic carrier granules having toner particles adhering thereto triboelectrically. More particularly, the carrier granules include a ferromagnetic core having a thin layer of magnetic material overcoated with a non-continuous layer of resinous material. Suitable resins include poly(vinylidene fluoride) and poly(vinylidene fluoride-co-tetrafloroethylene). The developer composition can be prepared by mixing the carrier granules with the toner particles. Suitable toner particles are prepared by finely grinding a resinous material and mixing it with a coloring material. By way of example, the resinous material may be a vinylpolymer such as polyvinyl-chloride, polyvinylidene chloride, polyvinylacetate, polyvinylacetales, polyvinylether, and polyacrelic. Suitable coloring materials may be, amongst others, chromogen black and solvent black. The developer comprises about 95% to 99% by weight of carrier and from 5% to about 1% weight of toner. These and other materials are disclosed in U.S. Pat. No. 4,076,857 issued to Kasper et al. in 1978, the relevant portions thereof being hereby incorporated into the present application.

Figure 3:
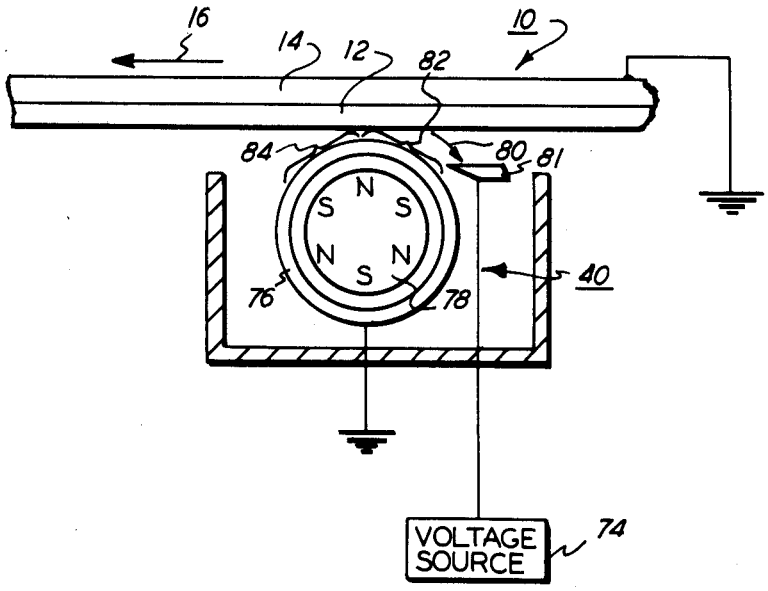
FIG. 3 is a schematic elevational view illustrating another embodiment of a development system used in the FIG. 1 printing machine.

Turning now to FIG. 3, there is shown another embodiment of development system 36. As depicted thereat, this embodiment only employs a single insulating magnetic brush roller. Magnetic brush roller 80 includes a tubular member 76 which is non-magnetic and insulating. Once again, tubular member 76 is preferably made from a phenolic resin having a resistivity ranging from about $10^5$ ohm-centimeters to about $10^8$ ohm-centimeters. Tubular member 76 is electrically grounded. An elongated magnetic rod 78 is positioned concentrically within tubular member 76 being spaced from the interior surface thereof. Blade 81 has the leading edge thereof closely adjacent to tubular member 76 so as to meter the quantity of developer material being transported thereby. Voltage source 76 is connected to blade 81. Blade 81 is electrically biased to a voltage ranging from about 25 volts to about 125 volts above the background potential. Tubular member 76 rotates in the direction of arrow 80. Hence, as tubular member 76 rotates in the direction of arrow 80, the developer material moves into the entrance portion 82 of the development zone. In this region, the electrical field vector is substantially perpendicular to photoconductive surface 12. As tubular member 80 continues to rotate it moves into the exit region 84 of the development zone. In exit region 84, the electrical field vector is non-perpendicular to photoconductive surface 12 or ideally substantially parallel to photoconductive surface 12. Thus, it is seen that the electrical field vector within the development zone varies from being substantially perpendicular to photoconductive surface 12 to being substantially non-perpendicular or transverse to photoconductive surface 12. In this manner, the conductivity of the developer mixture varies from a maximum to a significantly lower level. Hence, the developer mixture initially develops the solid areas in entrance region 82 and further develops the lines in exit region 84. Moreover, particles adhering to the non-image or background areas are scavenged from photoconductive surface 12 in exit region 84.

While tubular member 76 has been described in both FIGS. 2 and 3 as being made from a phenolic resin, one skilled in the art will appreciate that it may also comprise an inner-conductive cylindrical sleeve having a dielectric material coated thereon. By way of example, the dielectric material may be a phenolic resin with a conductive sleeve being made from a non-magnetic material, such as aluminum. Alternatively, the dielectric layer may coat the interior circumferential surface of the conductive sleeve rather than the exterior circumferential surface thereof.

Figure 4:
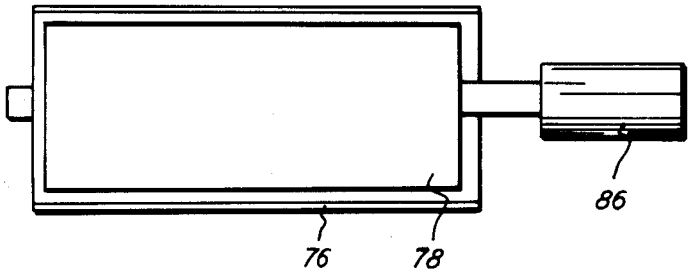
FIG. 4 is a schematic elevational view depicting a drive system for use in the FIG. 2 or FIG. 3 development systems.

Referring now to FIG. 4, there is depicted a drive system which may be utilized for either drive roller 38 or 40 in either of the embodiments depicted in FIGS. 2 or 3. The drive system is identical for both rollers. Hence, only the drive system associated with developer roller 40 will be described hereinafter inasmuch as it is utilized in both the embodiments of FIG. 2 and that of FIG. 3. As shown thereat, a constant speed motor 86 is coupled to tubular member 76. Tubular member 76 is mounted on suitable bearings so as to be rotatable. Magnetic rod 78 is substantially fixed interiorly of tubular member 76. Excitation of motor 86 rotates tubular member 76 in the direction of arrow 80 (FIG. 3). In this way, the developer mixture moves also in the direction of arrow 80, i.e. in the direction of motion of belt 10, as indicated by arrow 16.

In recapitulation, it is evident that the development apparatus of the present invention is capable of operating in either of two modes. In one mode of operation, the electrical field vector is substantially perpendicular to the photoconductive surface over a portion of the development zone with the electrical field vector being substantially non-perpendicular to the photoconductive surface over the remaining portion of the development zone. Alternatively, in another mode of operation, the electrical field vector is substantially perpendicular to the photoconductive surface over the entire development zone. This system may employ a plurality of developer rollers or one developer roller. When a plurality or two developer rollers are employed, one developer roller preferably includes a conductive tubular member having a magnetic member disposed interiorly thereof. The other magnetic brush roller includes a insulating tubuar member having a magnetic member disposed interiorly thereof. Both of the tubular members are non-magnetic. A metering blade is disposed closely adjacent to the insulating member. In one mode of operation, i.e. when the electrical field vector is substantially perpendicular to the photoconductive surface over the entire development zone, the meter blade is electrically biased. In another mode of operation, i.e. when the electrical field vector is substantially perpendicular to the photoconductive surface over a portion of the development zone with the electrical field vector being non-perpendicular to the photoconductive surface over the remaining portion of the development zone, the metering blade is not electrically biased. Alternatively, in another embodiment, wherein one magnet brush developer roller is employed, the magnetic brush roller is preferably made from an insulating tubular member having a magnetic rod disposed interiorly thereof. In this latter embodiment, the metering blade is electrically biased. Hence, the electrical field vector is substantially perpendicular to the photoconductive surface in the entrance region of the development zone and substantially non-perpendicular to the photoconductive surface in the exit region of the development zone. In this way, depending upon the type of original document being reproduced, copy quality may be optimized.

It is, therefore, evident that there has been provided, in accordance with the present invention, an apparatus for developing both the solid areas and low density lines contained within an image. This apparatus fully satisfies the aims and advantages hereinbefore set forth. While this invention has been described in conjunction with specific embodiments and modes of operation, it is evident that many alternatives, modifications and variations will be apparent to those skilled in the art. Accordingly, it is intended to embrace all such alternatives, modifications, and variations as fall within the spirit and broad scope of the appended claims.

What is claimed is:

1. An apparatus for developing an electrostatic latent image recorded on a surface region with conductive developer material, including:

electrically insulating means for transporting developer material adhering removably on the exterior surface thereof into contact with the surface region to develop the latent image recorded thereon;

an electrically conducting member spaced from and disposed closely adjacent to said insulating means and the region of the surface; and means for electrically biasing said conducting member to generate an electrical field between said insulating means and the surface region with the electrical field vector varying from being substantially perpendicular to the surface region in the portion of the region adjacent said conducting member to being substantially non-perpendicular to the surface region in the portion of the region remote from said conducting member.

2. An apparatus for developing an electrostatic latent image recorded on a surface region with conductive developer material, including:

electrically insulating means for transporting developer material adhering removably on the exterior surface thereof into contact with the surface region;

an electrically conducting member spaced from and disposed closely adjacent to said insulating means and the region of the surface;

electrically conductive means, spaced from said insulating means and said conducting member for transporting developer material adhering removably on the exterior surface thereof into contact with the surface region;

means for electrically biasing said conductive means so that the electrical field vector between said conductive means and said surface region is substantially perpendicular to the surface region in the vicinity of the conductive means; and operator actuatable means for connecting and disconnecting said biasing means from said conducting member so that the electrical field vector between said insulating means and said surface region in the vicinity of said insulating means, is substantially perpendicular to the surface region when said biasing means is connected to said conducting member and is substantially non-perpendicular to the surface region when said biasing means is disconnected from said conducting member.

3. An apparatus as recited in claim 2, wherein said conductive means includes:

a rotatable non-magnetic, conductive tubular member coupled to said electrical biasing means;

a first magnetic member disposed interiorly of said conductive tubular member; and means for rotating said conductive tubular member with said first magnetic member being substantially stationary.

4. An apparatus as recited in claim 3, wherein said insulating means includes:

a rotatable non-magnetic, insulating tubular member;

a second magnetic member disposed interiorly of said tubular member; and means for rotating said insulating tubular member with said second magnetic member being substantially stationary.

5. An apparatus as recited in claim 4, wherein said conducting member is positioned to have one edge thereof closely adjacent to said insulating tubular member so as to regulate the quantity of developer material being transported by said insulating tubular member.

* * * * *